US008709108B2

(12) United States Patent
Claydon

(10) Patent No.: US 8,709,108 B2
(45) Date of Patent: Apr. 29, 2014

(54) FUEL COMPOSITIONS

(75) Inventor: David John Claydon, Oxfordshire (GB)

(73) Assignee: Afton Chemical Corporation, Richmond, VA (US)

( * ) Notice: Subject to any disclaimer, the term of this patent is extended or adjusted under 35 U.S.C. 154(b) by 834 days.

(21) Appl. No.: 12/236,867

(22) Filed: Sep. 24, 2008

(65) Prior Publication Data

US 2010/0075876 A1 Mar. 25, 2010

(51) Int. Cl.
*C10L 1/18* (2006.01)

(52) U.S. Cl.
USPC ..... 44/388; 44/347; 44/412; 44/450

(58) Field of Classification Search
USPC ..... 44/412, 450, 388, 347
See application file for complete search history.

(56) References Cited

U.S. PATENT DOCUMENTS

| | | | | |
|---|---|---|---|---|
| 3,172,892 | A | 3/1965 | Le Suer et al. | |
| 3,202,678 | A | 8/1965 | Stuart et al. | |
| 3,216,936 | A | 11/1965 | Le Suer et al. | |
| 3,219,666 | A | 11/1965 | Norman et al. | |
| 3,254,025 | A | 5/1966 | Le Suer et al. | |
| 3,272,746 | A | 9/1966 | Le Suer et at. | |
| 4,152,499 | A | 5/1979 | Boerzel et al. | |
| 4,234,435 | A | 11/1980 | Meinhardt et al. | |
| 5,575,823 | A * | 11/1996 | Wallace et al. | 44/359 |
| 5,679,116 | A | 10/1997 | Cunningham et al. | |
| 2004/0244278 | A1 * | 12/2004 | Siggelkow et al. | 44/389 |
| 2005/0039381 | A1 | 2/2005 | Langer et al. | |
| 2005/0115146 | A1 * | 6/2005 | Jackson et al. | 44/450 |
| 2005/0223629 | A1 | 10/2005 | Sutkowski et al. | |
| 2006/0281642 | A1 | 12/2006 | Colbourne et al. | |

FOREIGN PATENT DOCUMENTS

| | | | |
|---|---|---|---|
| EP | 0203692 | | 12/1986 |
| EP | 1918355 | A1 | 7/2008 |
| GB | 2156848 | A | 10/1985 |
| GB | 2239258 | A | 6/1991 |
| WO | 02102942 | | 12/2002 |
| WO | WO2008056203 | * | 5/2008 |
| WO | 2009016400 | | 2/2009 |
| WO | 2009108851 | A1 | 3/2009 |

OTHER PUBLICATIONS

UK Search Report issued Jan. 26, 2010.
EPO Search Report, EPO Application No. 09252359.6, EPO, Mar. 4, 2010.

* cited by examiner

*Primary Examiner* — Cephia D Toomer
(74) *Attorney, Agent, or Firm* — Novak Druce Connolly Bove + Quigg LLP

(57) ABSTRACT

There is disclosed a fuel composition comprising (a) a major amount of a middle distillate fuel comprising from about 0.5% to about 30% by weight fatty acid methyl esters, relative to the total amount of the fuel composition; and (b) a minor amount of an additive composition comprising an antioxidant system comprising at least one cyclic amine antioxidant and at least one phenolic antioxidant, and at least one ashless dispersant, wherein said fuel composition demonstrates reduced sediment formation as compared to a fuel composition devoid of the additive composition, and methods of use thereof.

15 Claims, No Drawings

FUEL COMPOSITIONS

FIELD OF THE INVENTION

This disclosure relates generally to fuel compositions. More specifically, the present disclosure is directed to middle distillate fuel compositions, such as diesel and/or biodiesel fuel compositions, suitable for home heating applications and the like.

BACKGROUND OF THE INVENTION

There is interest in and a need for an ashless additive in middle distillate fuels such as diesel fuel, including heating oil. Previously, middle distillate fuel compositions often contained ash-producing metals, such as manganese or iron to obtain good soot reduction upon combustion. Recently, the move to ashless technology is being driven by the introduction of highly efficient burner technology coupled with new boiler hardware that is based on a condenser design, whereby condensed water goes into the public water system. The industry has decided that the use of metallic combustion improvers, such as those based on iron or manganese, are no longer required in the highly efficient modern burners. However, fuel compositions without ash-producing metals have not demonstrated completely acceptable performance. The industry has recently experienced operational difficulties resulting from the production of insoluble sediment in middle distillate fuels, including heating oil.

Thus, a need exists for an additive for middle distillate fuels, particularly for home heating oils, such as biodiesel fuel, for example diesel fuels containing 10% fuel derived from biological sources (also known as "biodiesel 10" or "B10"), that effectively reduces sediment formation in fuel compositions and improves heating power in home heating applications.

SUMMARY OF THE DISCLOSURE

According to various embodiments, there is provided a fuel composition comprising (a) a major amount of a middle distillate fuel comprising from about 0.5% to about 30% by weight fatty acid methyl esters, relative to the total amount of the fuel composition; and (b) a minor amount of an additive composition comprising an antioxidant system comprising at least one cyclic amine antioxidant and at least one phenolic antioxidant, and at least one ashless dispersant, wherein said fuel composition demonstrates reduced sediment formation as compared to a fuel composition devoid of the additive composition.

According to various embodiments, there is also provided a method of reducing sediment formation in a fuel composition, said method comprising providing a major amount of a middle distillate fuel comprising from about 0.5% to about 30% by weight fatty acid methyl esters; and mixing with said fuel a minor amount of an additive composition comprising an antioxidant system comprising at least one cyclic amine antioxidant and at least one phenolic antioxidant, and at least one ashless dispersant.

Additional objects and advantages of the disclosure will be set forth in part in the description which follows, and can be learned by practice of the disclosure. The objects and advantages of the disclosure will be realized and attained by means of the elements and combinations particularly pointed out in the appended claims.

It is to be understood that both the foregoing general description and the following detailed description are exemplary and explanatory only and are not restrictive of the disclosure, as claimed.

DESCRIPTION OF THE EMBODIMENTS

The present disclosure relates to a fuel composition comprising (a) a major amount of a middle distillate fuel comprising from about 0.5% to about 30% by weight fatty acid methyl esters, relative to the total amount of the fuel composition; and (b) a minor amount of an additive composition comprising an antioxidant system comprising at least one aromatic amine antioxidant and at least one phenolic antioxidant, and at least one ashless dispersant, wherein said fuel composition demonstrates reduced sediment formation as compared to a fuel composition devoid of the additive composition.

As used herein, "middle distillate fuel" is understood to mean one or more fuels selected from the group consisting of diesel fuel, biodiesel, biodiesel-derived fuel, synthetic diesel, diesel fuel treated with oxygenates for particulate control, mixtures thereof, and other products meeting the definitions of ASTM D975. In an aspect, the middle distillate fuel can contain up to 30%, for example from about 0.5% to about 30%, such as from about 10% to about 20%, fuel derived from biological sources. As used herein, "biodiesel" is understood to mean diesel fuel comprising fuel derived from biological sources The middle distillate fuel can be derived from biological sources such as oleaginous seeds, for example rapeseed, sunflower, soybean seeds, and the like. The seeds can be submitted to grinding and/or solvent extraction treatments (e.g., with n-hexane) in order to extract the oil, which comprises triglycerides of saturated and unsaturated (mono- and poly-unsaturated, in mixture with each other, in proportions depending on the selected oleaginous seed) $C_{16}$-$C_{22}$ fatty acids. The oil can be submitted to a filtration and refining process, in order to remove any possible free fats and phospholipids present, and can be submitted to a transesterification reaction with methanol in order to prepare the methyl esters of the fatty acids (fatty acid methyl esters, also known as "FAME").

When middle distillate fuel containing up to 30% fatty acid methyl esters (e.g., B10 or B20 fuel) is stored over an extended period of time, the fuel tends to form sediment, which can contribute to pump failure prior to combustion. It is believed, without being limited by theory, that oxidation of fatty acid methyl esters can cause sediment formation, which can block pumps and cause pump failure.

As used herein, the term "major amount" is understood to mean an amount greater than or equal to 50 wt. %, for example from about 80 to about 98 wt. % relative to the total weight of the composition. Moreover, as used herein, the term "minor amount" is understood to mean an amount less than 50 wt. % relative to the total weight of the composition.

As used herein, "aromatic," unless expressly stated otherwise, refers to the typical substituted or unsubstituted non-aliphatic hydrocarbyl or heterocyclic moieties of this class, e.g., a polyunsaturated, typically aromatic, hydrocarbyl cyclical, or heterocyclic, substituent, which can have a single ring or multiple rings (up to three rings) that are fused together or linked covalently. Typical hydrocarbyl aromatic moieties include phenyl, naphthyl, biphenylenyl, phenanthrenyl, phenalenyl, and the like. Such moieties are optionally substituted with one or more hydrocarbyl substituents. Also included are aryl moieties substituted by other aryl moieties, such as biphenyl. Heterocyclic aryl or aromatic moieties refers to unsaturated cyclical moieties containing carbon atoms in the ring and additionally one or more hetero atoms, which are typically oxygen, nitrogen, sulfur and/or phosphorus, such as pyridyl, thienyl, furyl, thiazolyl, pyranyl, pyrrolyl, pyrazolyl, imidazolyl, pyrazinyl, thiazolyl, etc. Such moieties are optionally substituted with one or more substituents such as hydroxy, optionally substituted lower alkyl, optionally substituted lower alkoxy, amino, amide, ester moieties and carbonyl moieties (e.g., aldehyde or ketonic moieties).

As used herein, the term "hydrocarbyl group" or "hydrocarbyl" is used in its ordinary sense, which is well-known to those skilled in the art. Specifically, it refers to a group having a carbon atom directly attached to the remainder of a molecule and having a predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of the description herein, do not alter the predominantly hydrocarbon substituent (e.g., halo (especially chloro and fluoro), hydroxy, alkoxy, mercapto, alkylmercapto, nitro, nitroso, and sulfoxy);

(3) hetero-substituents, that is, substituents which, while having a predominantly hydrocarbon character, in the context of this description, contain other than carbon in a ring or chain otherwise composed of carbon atoms. Hetero-atoms include sulfur, oxygen, nitrogen, and encompass substituents such as pyridyl, furyl, thienyl, and imidazolyl. In general, no more than two, or as a further example, no more than one, non-hydrocarbon substituent will be present for every ten carbon atoms in the hydrocarbyl group; in some embodiments, there will be no non-hydrocarbon substituent in the hydrocarbyl group.

As used herein, the term "succinimide" is meant to encompass the completed reaction product from reaction between an amine and a hydrocarbyl-substituted succinic acid or anhydride (or like succinic acylating agent), and is intended to encompass compounds wherein the product may have amide, and/or salt linkages in addition to the imide linkage of the type that results from the reaction of or contact with an amine and an anhydride moiety. By "reacting" herein with regard to the alkylation is meant the product or result of contacting, exposing or bringing together any of the recited components or chemicals, whether a covalent bond, ionic bond, salt or other association is produced.

Ashless dispersants are described in numerous patent specifications, mainly as additives for use in lubricant compositions, but their use in middle distillate fuels has also been described. Ashless dispersants leave little or no residue upon combustion. They generally contain only carbon, hydrogen, oxygen and in most cases nitrogen, but sometimes contain in addition other elements such as phosphorus, sulfur, or boron.

Ashless dispersant compounds suitable for use in the fuel compositions of the present disclosure can be a hydrocarbyl-substituted succinimide of an amine having at least one primary amino group capable of forming an imide group. Representative examples are given in U.S. Pat. Nos. 3,172,892; 3,202,678; 3,216,936; 3,219,666; 3,254,025; 3,272,746; and 4,234,435, the disclosures of which are incorporated herein in their entirety.

The hydrocarbyl-substituted succinimides can be formed by conventional methods such as by heating a hydrocarbyl-substituted succinic anhydride, acid, acid-ester, acid halide, or lower alkyl ester with an amine containing at least one primary amino group. The hydrocarbyl-substituted succinic anhydride can be made readily by heating a mixture of olefin and maleic anhydride to about 180° to about 220° C. In an aspect, the olefin can be a polymer or copolymer of a lower monoolefin such as ethylene, propylene, isobutene and the like. In an embodiment, the hydrocarbyl-substitutent is derived from polyisobutene having a number average molecular weight, as determined by gel permeation chromatography, of up to 10,000 or higher, such as from about 500 to about 5,000, for example from about 900 to about 2,000, for instance from about 900 to about 1,200.

Amines that can be employed in forming the ashless dispersant include any that have at least one primary amino group which can react to form an imide group. A few non-limiting representative examples include methylamine, 2-ethylhexylamine, n-dodecylamine, stearylamine, N,N-dimethyl-propanediamine, N-(3-aminopropyl)morpholine, N-dodecyl-propanediamine, N-aminopropyl-piperazine, ethanolamine, N-ethanol-ethylenediamine and the like.

In an aspect, the amines can be alkylene polyamines such as propylene diamine, dipropylene triamine, di-(1,2-butylene)triamine, and tetra-(1,2-propylene)pentanine. In an embodiment, the amines are the ethylene polyamines that can be depicted by the formula $H_2N(CH_2CH_2NH)_nH$, wherein n is an integer from one to about ten. Non-limiting examples include: ethylene diamine, diethylene triamine, triethylene tetramine, tetraethylene pentamine, pentaethylene hexamine, and the like, including mixtures thereof (in which case n is the average value of the mixture.) These ethylene polyamines have a primary amine group at each end and so can form mono-alkenylsuccinimides and bis-alkenylsuccinimides. Commercially available ethylene polyamine mixtures usually contain minor amounts of branched species and cyclic species such as N-aminoethyl piperazine, N,N'-bis(aminoethyl)piperazine, N,N'-bis(piperazinyl)ethane, and like compounds. In another embodiment, commercial mixtures can have approximate overall compositions falling in the range corresponding to diethylene triamine to tetraethylene pentamine. In a further embodiment, commercial mixtures can generally correspond in overall makeup to tetraethylene pentamine.

Thus, useful ashless dispersants for use in the present invention can be the products of reaction of a polyethylene polyamine (e.g. triethylene tetramine or tetraethylene pentamine) with a hydrocarbyl-substituted carboxylic acid or anhydride made by reaction of a polyolefin (such as polyisobutene) with an unsaturated polycarboxylic acid or anhydride, e.g., maleic acid, fumaric acid, malic acid, tartaric acid, itaconic acid, itaconic anhydride, citraconic acid, citraconic anhydride, mesaconic acid, ethylmaleic anhydride, dimethylmaleic anhydride, ethylmaleic acid, dimethylmaleic acid, hexylmaleic acid, and the like, including mixtures of two or more such substances. In an aspect, the reaction product can form an amide based on intermolecular condensation upon standing for long periods of time, such as about 1 to about 6 months, for example about 1 to about 3 months.

In an embodiment, the ashless dispersant can be a compound according to the following formula:

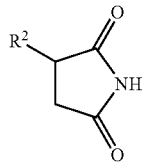

wherein $R^2$ is a hydrocarbyl group having a number average molecular weight ranging from about 500 to about 5,000, such as from about 900 to about 2,000, for example from about 900 to about 1,200, as measured by GPC. Unless indicated otherwise, molecular weights in the present specification are number average molecular weights.

The $R^2$ hydrocarbyl groups can comprise one or more polymer units chosen from linear or branched alkenyl units. In some aspects, the alkenyl units can have from about 20 to about 200 carbon atoms. For example, the hydrocarbyl group can comprise one or more linear or branched polymer units chosen from ethylene radicals, propylene radicals, butylene radicals, pentene radicals, hexene radicals, octene radicals and decene radicals. In some aspects, the $R^2$ hydrocarbyl group can be in the form of, for example, a homopolymer, copolymer or terpolymer. In one aspect, the hydrocarbyl group is polyisobutylene. For example, the hydrocarbyl group can be a homopolymer of polyisobutylene comprising from about 10 to about 60 isobutylene groups, such as from about 20 to about 30 isobutylene groups. The polyalkenyl compounds used to form the $R^2$ hydrocarbyl groups can be formed by any suitable methods, such as by conventional catalytic oligomerization of alkenes.

In an additional aspect, the $R^2$ hydrocarbyl group can be derived from a linear alpha olefin or an acid-isomerized alpha olefin made by the oligomerization of ethylene by methods well known in the art. These hydrocarbyl groups can range from about 8 carbon atoms to over 40 carbon atoms. For example, hydrocarbyl groups of this type can be derived from a linear $C_{18}$ or a mixture of $C_{20-24}$ alpha olefins or from acid-isomerized $C_{16}$ alpha olefins.

In some aspects, polyisobutylenes having at least about 60%, such as about 70% to about 90% and above, terminal vinylidene content can be used to form the $R^2$ hydrocarbyl group. As used herein, "terminal vinylidene content" is understood to mean terminal olefinic double bond content. Such polymers are referred to as highly reactive polyisobutylenes (HR-PIB). There is a general trend in the industry to convert to HR-PIB, and well known HR-PIBs are disclosed, for example, in U.S. Pat. No. 4,152,499, the disclosure of which is herein incorporated by reference in its entirety.

In some aspects, approximately one mole of maleic anhydride can be reacted per mole of polyolefin, such that the resulting polyalkenyl succinic anhydride has about 0.8 to about 1 succinic anhydride group per hydrocarbyl substituent. In other aspects, the weight ratio of succinic anhydride groups to alkylene groups can range from about 0.5 to about 3.5, such as from about 1 to about 1.1.

The reactants described above can be mixed together under suitable conditions to provide the desired reaction products of the present disclosure. In an aspect, the reactant compounds can be mixed together in a mole ratio of hydrocarbyl-substituted succinic acid or anhydride to amine ranging from about 1:1 to about 1:2.5; such as from about 1:1 to about 1:2.2. Suitable reaction temperatures can range from about 155° C. to about 200° C., such as from about 160° C. to about 190° C. Any suitable reaction pressures may be used, such as, atmospheric pressures, subatmospheric pressures or superatmospheric pressures. However, the range of temperatures can be different from those listed where the reaction is carried out at other than atmospheric pressure. The reaction can be carried out for a period of time within the range of about 1 hour to about 8 hours, for example, within the range of about 2 hours to about 6 hours.

The ashless dispersant can be present in the disclosed fuel composition in any desired or effective amount, such as a sediment reducing amount. In an aspect, the ashless dispersant, such as a hydrocarbyl-substituted succinimide, can be present in the fuel composition in an amount ranging from about 60 ppm to about 300 ppm, for example from about 60 ppm to about 200 ppm, such as from about 60 ppm to about 90 ppm.

The disclosed fuel compositions can include an antioxidant system. Such antioxidants are well known and there is no particular restriction of the type of antioxidant employed, provided it is oil-soluble or oil-dispersible. Suitable antioxidants include, but are not limited to, amininic antioxidants, aromatic antioxidants, cyclic amine antioxidants, and aromatic amine antioxidants, such as alkyl substituted diphenylamine, alkyl substituted phenyl, and napthylamines. Suitable aromatic antioxidants include, but are not limited to, hindered phenols, such as 2,6-di-tert-butyl-phenol, 2,4,6-tri-tert-butyl-phenol, 4-methyl-2,6-di-tert-butyl-phenol, 2,4-dimethyl-6-tert-butyl-phenol, 4,4'-methylenebis(2,6-di-tert-butyl-phenol), mixed methylene bridged polyalkyl phenols, and the like. Suitable aromatic amine antioxidants include, but are not limited to, diphenylamine, alkyldiphenylamines having one or more alkyl substituents each comprising up to about 16 carbon atoms, phenyl-alpha-naphthylamine, phenyl-beta-naphthylamine, alkyl-substituted phenyl-alpha-naphthylamine or phenyl-beta-naphthylamine having one or more alkyl substituents each comprising up to about 16 carbon atoms, and the like. Non-limiting examples of suitable alkyl substituents include t-butyl, t-pentyl, hexyl, n-octyl, t-octyl, nonyl, decyl and dodecyl. A non-limiting example of a cyclic amine antioxidant is N,N-dimethyl cyclohexamine.

The antioxidant system can be present in the fuel composition in any desired or effective amount, such as a sediment reducing amount. In an aspect, the antioxidant system can be present in the fuel composition in an amount to provide from about 20 ppm to about 100 ppm, such as from about 20 ppm to about 80 ppm, for example from about 20 ppm to about 40 ppm, of the antioxidants to the fuel composition.

Middle distillate fuels for use in the disclosed composition include, but are not limited to, home heating oils. The present disclosure is thus applicable to such fuels as kerosene, jet fuel, aviation fuel, diesel fuel, light cycle oil, heavy cycle oil, light gas oil, heavy gas oil, bunker fuels, residual fuel oils, ultra heavy fuel oils, and in general, any liquid (or flowable) hydrocarbonaceous product suitable for combustion either in an engine (e.g., diesel fuel, gas turbine fuels, etc.) or in a burner apparatus (e.g., gas oils, inland heavy fuel oil, residual fuel oils, visbreaker fuel oils, home heating oils, etc.). Other suitable fuels can include liquid fuels derived from biological sources, such as vegetable oils (e.g., rapeseed oil, jojoba oil, cottonseed oil, etc.); or refuse-derived liquid fuels such as fuels derived from municipal and/or industrial wastes; or waste oils and/or liquid waste biomass and its derivatives; or mixtures of any of the foregoing substances.

In an embodiment, the middle distillate fuel comprises up to about 30%, such as from about 0.5% to about 30%, for example from about 10% to about 20% by weight relative to the total weight of the fuel composition, of fuel derived from biological sources. In a further embodiment, the middle distillate fuel can comprise up to about 30% by weight of fatty acid methyl esters, such as from about 0.5% to about 30%, for example from about 10% to about 20% by weight of fatty acid methyl esters, relative to the total weight of the fuel composition. The middle distillate fuel can be present in a major amount in the fuel composition.

The fuel compositions of the present disclosure can contain other additives. Non-limiting examples of additives include supplementary dispersants/detergents, antioxidants, thermal stabilizers, carrier fluids, metal deactivators, dyes, markers, corrosion inhibitors, biocides, antistatic additives, drag reducing agents, friction modifiers, demulsifiers, emulsifiers, dehazers, anti-icing additives, antiknock additives, anti-valve-seat recession additives, surfactants, other lubricity additives combustion improvers, cetane number improvers, and mixtures thereof.

EXAMPLES

TABLE 1

| Sample | Phenolic AO* | Cyclic amine AO** | Phenolic AO*** | Succinimide | HiTEC 4036 | Stability |
|---|---|---|---|---|---|---|
| 1 | 38 | 20 | 0 | 0 | 0 | Heavy Sediment |
| 2 | 50 | 20 | 0 | 0 | 0 | Heavy sediment |
| 3 | 80 | 20 | 0 | 0 | 0 | Sediment |
| 4 | 100 | 20 | 0 | 0 | 0 | Sediment |
| 5 | 0 | 20 | 38 | 0 | 0 | Heavy sediment |
| 6 | 0 | 20 | 50 | 0 | 0 | Heavy sediment |
| 7 | 0 | 20 | 80 | 0 | 0 | Sediment |
| 8 | 0 | 20 | 100 | 0 | 0 | Sediment |
| 9 | 38 | 20 | 0 | 60 | 0 | No sediment |
| 10 | 38 | 20 | 0 | 90 | 0 | No sediment |
| 11 | 0 | 0 | 0 | 0 | 500 | Sediment |

*2,6-di-tert-butyl-phenol
**N-N-dimethyl cyclohexamine
***2,4,6-tri-tert-butyl-phenol A diesel fuel comprising 10% fatty acid methyl esters was formulated with different combinations of dispersants and antioxidants according to Table 1 above. HiTEC® 4036 delivered 38 ppm 2,6-di-tert-butylphenol, 20 ppm N,N-dimethyl cyclohexamine, and 30 ppm succinimide to the finished fuel. The fuel samples were stored at 50° C. for 3 months. At the end of 3 months, a visible examination of sediment formation was conducted.

As can be seen from the results above, samples 1 through 8 delivered increasing amounts of different phenolic antioxidants in an attempt to prevent sediment formation. However, all of samples 1 through 8 formed sediment. Thus, it is evident from the results above that increasing the amount of antioxidant does not reduce sediment formation.

But the addition of an antioxidant system and at least 60 ppm of a succinimide to a diesel fuel comprising FAME results in a fuel that produces no sediment upon standing over an extended period of time, as shown in samples 9 and 10. Moreover, sample 11 comprising an antioxidant system and 30 ppm of a succinimide formed sediment, while samples 9 and 10 comprising an antioxidant system and much higher levels of a succinimide (at least 60 ppm) did not form sediment. Accordingly, it can be seen from the testing above that the disclosed additive composition can effectively prevent sediment formation in middle distillate fuels comprising FAME (and, in turn, can lead to increased heating power and reduced pump failure in home heating burners).

In an aspect, there is provided a method of reducing sediment formation in a fuel composition, said method comprising: providing a major amount of a middle distillate fuel comprising from about 0.5% to about 30% by weight fatty acid methyl esters; and mixing with said fuel a minor amount of an additive composition comprising an antioxidant system comprising at least one cyclic amine antioxidant and at least one phenolic antioxidant, and at least one ashless dispersant.

While the invention has been illustrated with respect to one or more implementations, alterations and/or modifications can be made to the illustrated examples without departing from the spirit and scope of the appended claims. In addition, while a particular feature of the invention may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." The term "at least one of" is used to mean one or more of the listed items can be selected.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g., −1, −2, −3, −10, −20, −30, etc.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is noted that, as used in this specification and the appended claims, the singular forms "a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A fuel composition comprising:

(a) a major amount of a middle distillate fuel comprising from about 0.5% to about 30% by weight fatty acid methyl esters, relative to the total amount of the fuel composition; and (b) a minor amount of an additive composition comprising an antioxidant system comprising N,N-dimethyl cyclohexamine, at least one phenolic antioxidant, and at least one hydrocarbyl-substituted succinimide dispersant, wherein the hydrocarbyl-substituted succinimide is present in an amount ranging from about 60 ppm to about 300 ppm, and wherein the N,N-dimethyl cyclohexamine and the at least one phenolic antioxidant are present in an amount to deliver from about 20 ppm to about 100 ppm;

wherein said fuel composition demonstrates reduced sediment formation as compared to a fuel composition devoid of the additive composition.

2. The fuel composition of claim 1, wherein the hydrocarbyl substituent of the succinimide is derived from polyisobutene having a number average molecular weight ranging from about 500 to about 5,000.

3. The fuel composition of claim 1, wherein the hydrocarbyl-substituted succinimide is present in an amount ranging from about 60 ppm to about 200 ppm.

4. The fuel composition of claim 1, wherein the hydrocarbyl-substituted succinimide is present in an amount ranging from about 60 ppm to about 90 ppm.

5. The fuel composition of claim 1, wherein the phenolic antioxidant is a tertiary butyl phenol.

6. The fuel composition of claim 1, wherein the phenolic antioxidant is a di-substituted tertiary butyl phenol.

7. The fuel composition of claim 1, wherein the middle distillate fuel comprises from about 10% to about 20% by weight fatty acid methyl esters.

8. The fuel composition of claim 1, further comprising at least one additive selected from the group consisting of supplementary dispersants/detergents, antioxidants, thermal stabilizers, carrier fluids, metal deactivators, dyes, markers, corrosion inhibitors, biocides, antistatic additives, drag reducing agents, friction modifiers, demulsifiers, emulsifiers, dehazers, anti-icing additives, antiknock additives, anti-valve-seat recession additives, surfactants, other lubricity additives combustion improvers, cetane number improvers, and mixtures thereof.

9. A method of reducing sediment formation in a fuel composition, said method comprising:

providing a major amount of a middle distillate fuel comprising from about 0.5% to about 30% by weight fatty acid methyl esters; and mixing with said fuel a minor amount of an additive composition comprising an antioxidant system comprising N,N-dimethylcyclohexamine, at least one phenolic antioxidant, and at least one hydrocarbyl-substituted succinimide dispersant, wherein the hydrocarbyl-substituted succinimide is present in an amount ranging from about 60 ppm to about 300 ppm, and wherein the N,N-dimethyl cyclohexamine and the at least one phenolic antioxidant are present in an amount to deliver from about 20 ppm to about 100 ppM.

10. The method of claim 9, wherein the hydrocarbyl-substituted succinimide is present in an amount ranging from about 60 ppm to about 200 ppm.

11. The method of claim 9, wherein the hydrocarbyl-substituted succinimide is present in an amount ranging from about 60 ppm to about 90 ppm.

12. The method of claim 9, wherein the phenolic antioxidant is a tertiary butyl phenol.

13. The method of claim 9, wherein the phenolic antioxidant is a di-substituted tertiary butyl phenol.

14. The fuel composition of claim 1, wherein the middle distillate fuel comprises from about 10% to about 20% by weight fatty acid methyl esters.

15. The method of claim 9, further comprising mixing with said fuel at least one additive selected from the group consisting of supplementary dispersants/detergents, antioxidants, thermal stabilizers, carrier fluids, metal deactivators, dyes, markers, corrosion inhibitors, biocides, antistatic additives, drag reducing agents, friction modifiers, demulsifiers, emulsifiers, dehazers, anti-icing additives, antiknock additives, anti-valve-seat recession additives, surfactants, other lubricity additives combustion improvers, cetane number improvers, and mixtures thereof.

* * * * *